US011453583B2

(12) United States Patent
Garcia et al.

(10) Patent No.: US 11,453,583 B2
(45) **Date of Patent: *Sep. 27, 2022**

(54) LIQUID DISPENSER WITH PROXIMITY AND POSITIONING SYSTEM

(71) Applicants: Regina M. Garcia, Alhambra, CA (US); Eric R. Garcia, Alhambra, CA (US)

(72) Inventors: Regina M. Garcia, Alhambra, CA (US); Eric R. Garcia, Alhambra, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/190,111

(22) Filed: Mar. 2, 2021

(65) Prior Publication Data

US 2021/0179414 A1 Jun. 17, 2021

Related U.S. Application Data

(63) Continuation of application No. 16/404,088, filed on May 6, 2019, now Pat. No. 10,988,366.

(60) Provisional application No. 62/668,039, filed on May 7, 2018.

(51) Int. Cl.
*B67D 3/00* (2006.01)

(52) U.S. Cl.
CPC ..... *B67D 3/0003* (2013.01); *B67D 3/0074* (2013.01); *B67D 3/0093* (2013.01)

(58) Field of Classification Search
CPC ... B67D 3/0003; B67D 3/0074; B67D 3/0093
USPC ..... 141/198
See application file for complete search history.

(56) References Cited

U.S. PATENT DOCUMENTS

| | | | | |
|---|---|---|---|---|
| 3,480,787 | A | 11/1969 | Johansen | H03K 17/941 250/221 |
| 4,015,645 | A | 4/1977 | Chamberlin | B65B 1/30 141/34 |
| 4,458,735 | A | 7/1984 | Houman | B67D 1/124 141/198 |
| 4,722,372 | A | 2/1988 | Hoffman | A47K 5/1209 141/98 |
| 6,053,359 | A | 4/2000 | Goulet | B67D 1/00 221/221 |
| 6,705,356 | B2 | 3/2004 | Barton | B67D 1/124 141/2 |
| 7,845,375 | B2 | 12/2010 | Dorney | A47G 19/2227 141/104 |

(Continued)

*Primary Examiner* — Timothy L Maust
(74) *Attorney, Agent, or Firm* — Eric R. Garcia, Esq.

(57) ABSTRACT

A liquid dispenser is provided that includes a housing configured to dispense liquid into a container, the housing having an outlet for dispensing liquid into the container. The liquid dispenser includes a proximity sensor disposed proximate to the outlet and configured to detect the container when the container is disposed proximate to the outlet; a light source disposed proximate to the outlet and configured to emit a beam of light to identify a location of liquid to be dispensed from the outlet; and a processor configured to determine whether the container is disposed proximate to the outlet based on an output signal from the proximity sensor; and illuminate the light source to project the beam of light towards an opening of the container based on the output signal from the proximity sensor, to inform a user of a location of liquid to be dispensed from the housing.

10 Claims, 3 Drawing Sheets

(56) References Cited

U.S. PATENT DOCUMENTS

| | | | | |
|---|---|---|---|---|
| 8,028,728 | B2 | 10/2011 | Cooper | B67D 1/0878 141/192 |
| 8,109,301 | B1 * | 2/2012 | Denise | G07F 9/023 141/360 |
| 8,881,957 | B2 * | 11/2014 | Zhou | F16K 17/087 222/481.5 |
| 10,568,467 | B2 * | 2/2020 | Enga | A47K 5/12 |
| 2007/0137726 | A1 * | 6/2007 | Yan | B67D 1/06 141/90 |
| 2007/0267098 | A1 | 11/2007 | Ozanne | B67D 1/1238 141/198 |
| 2013/0074978 | A1 * | 3/2013 | Rasmussen | B67D 1/0443 141/2 |
| 2013/0146179 | A1 | 6/2013 | McMahan | B67D 7/221 141/83 |

* cited by examiner

LIQUID DISPENSER WITH PROXIMITY AND POSITIONING SYSTEM

CROSS-REFERENCE TO RELATED APPLICATIONS

The present application is a continuation U.S. Non-Provisional application Ser. No. 16/404,088, filed May 6, 2019, entitled "LIQUID DISPENSER WITH PROXIMITY AND POSITIONING SYSTEM," which claims priority to U. S. Provisional Application Ser. No. 62/668,039, filed May 7, 2018, entitled "LIQUID DISPENSER WITH PROXIMITY AND POSITIONING SYSTEM," the disclosures of which are incorporated herein by reference

FIELD

The present invention generally relates to liquid dispensers, and more particularly to a liquid dispenser with a proximity and positioning system.

BACKGROUND

Liquid dispensers, such as water dispensers, may use a mechanical lever to actuate dispensing of liquid into a container, such as a cup. Conventional liquid dispensers, however, do not provide any indication to users as to whether the container is placed at a correct position with respect to the dispenser to capture the liquid dispensed from the dispenser. Particularly, where a container does not fit under a dispenser such that alignment between an opening of the container and an outlet of the dispenser may be unknown, liquid flowing from the outlet may not flow into the opening of the container thereby causing a spill.

What is needed is a liquid dispenser that allows a user to place a container, regardless of size, in an appropriate alignment with respect to the outlet to prevent spill and ensure that dispensed liquid flows into the opening without any spillage.

SUMMARY

According to various aspects of the subject technology, a liquid dispenser is provided. The liquid dispenser may include a housing configured to dispense liquid into a container, the housing having an outlet for dispensing liquid into the container. The liquid dispenser includes a proximity sensor disposed proximate to the outlet that is configured to detect the container when the container is disposed proximate to the outlet. The liquid dispenser also includes a light source disposed proximate to the outlet that is configured to emit a beam of light to identify a location of liquid to be dispensed from the outlet. The liquid dispenser further includes a processor configured to determine whether the container is disposed proximate to the outlet based on an output signal from the proximity sensor; and illuminate the light source to project the beam of light towards an opening of the container based on the output signal from the proximity sensor, to inform a user of a location of liquid to be dispensed from the housing.

According to various aspects of the subject technology, a method for dispensing liquid is disclosed. The method includes detecting placement of a container disposed proximate to an outlet of a liquid dispenser with a proximity sensor disposed proximate to the outlet; illuminating a beam of light on the container to identify a location of liquid to be dispensed from the outlet based on the detected placement of the container; and dispensing liquid into the container based on the detected placement of the container.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

The accompanying drawings, which are included to provide further understanding of the subject technology and are incorporated in and constitute a part of this specification, illustrate aspects of the subject technology and together with the description serve to explain the principles of the subject technology.

DETAILED DESCRIPTION

In the following detailed description, numerous specific details are set forth to provide a full understanding of the subject technology. It will be apparent, however, to one ordinarily skilled in the art that the subject technology may be practiced without some of these specific details. In other instances, well-known structures and techniques have not been shown in detail so as not to obscure the subject technology.

A liquid dispenser is disclosed that utilizes a proximity sensor to detect a container proximal to an outlet of the dispenser. When detected, a positioning system is activated that causes a beam of light to be illuminated or projected onto a surface of the container thereby informing the user where liquid dispensed from the outlet would flow when dispensed. By placing the beam of light on the surface of the container prior to dispensing the liquid, the user may readjust a position of the container as necessary, based on a location of the projected target onto the container, to ensure that liquid dispensed from the dispenser flows into the container without spillage.

Figure 1:
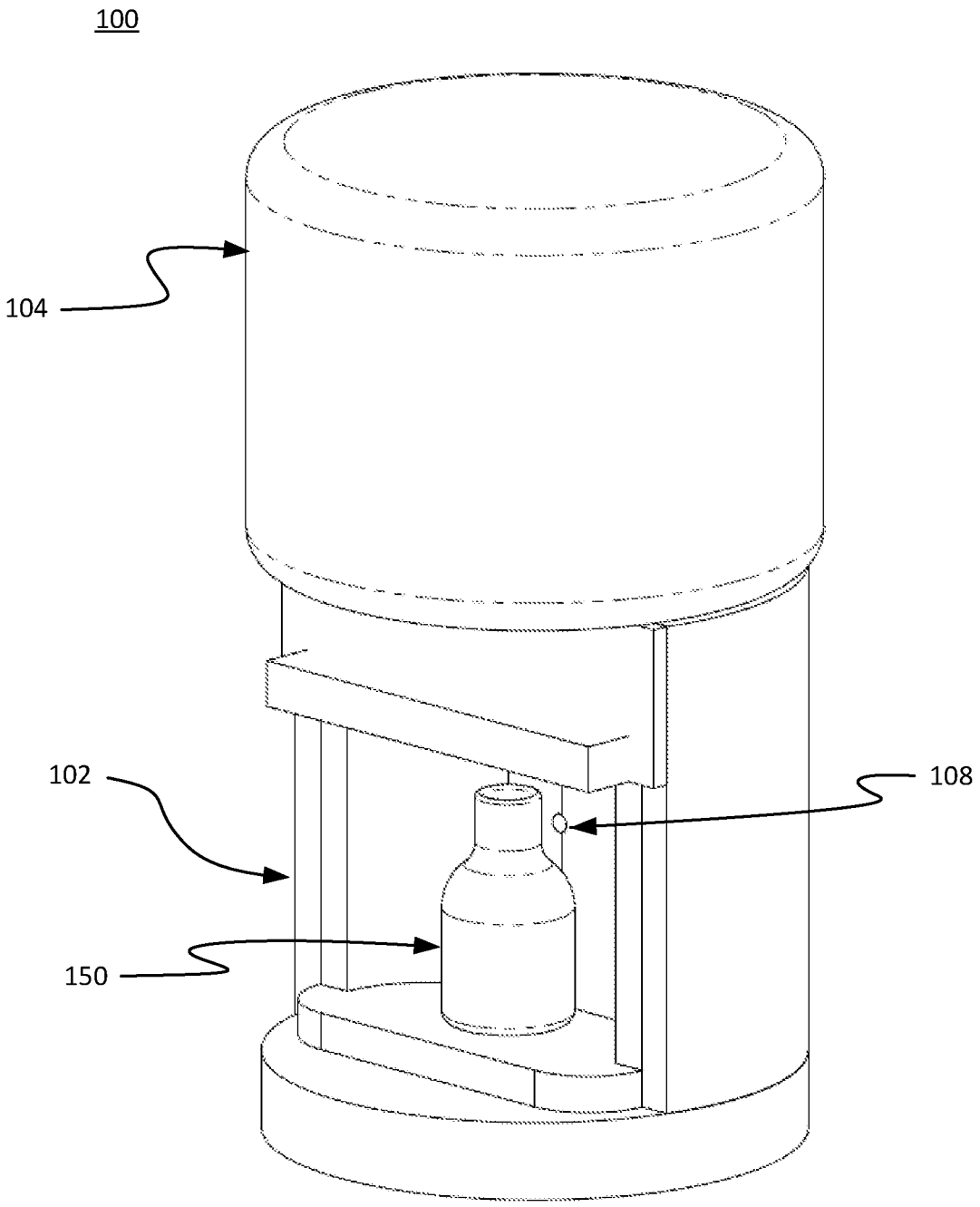
FIG. 1 illustrates a perspective view of a liquid dispenser, in accordance with various aspects of the subject technology.
Figure 2:
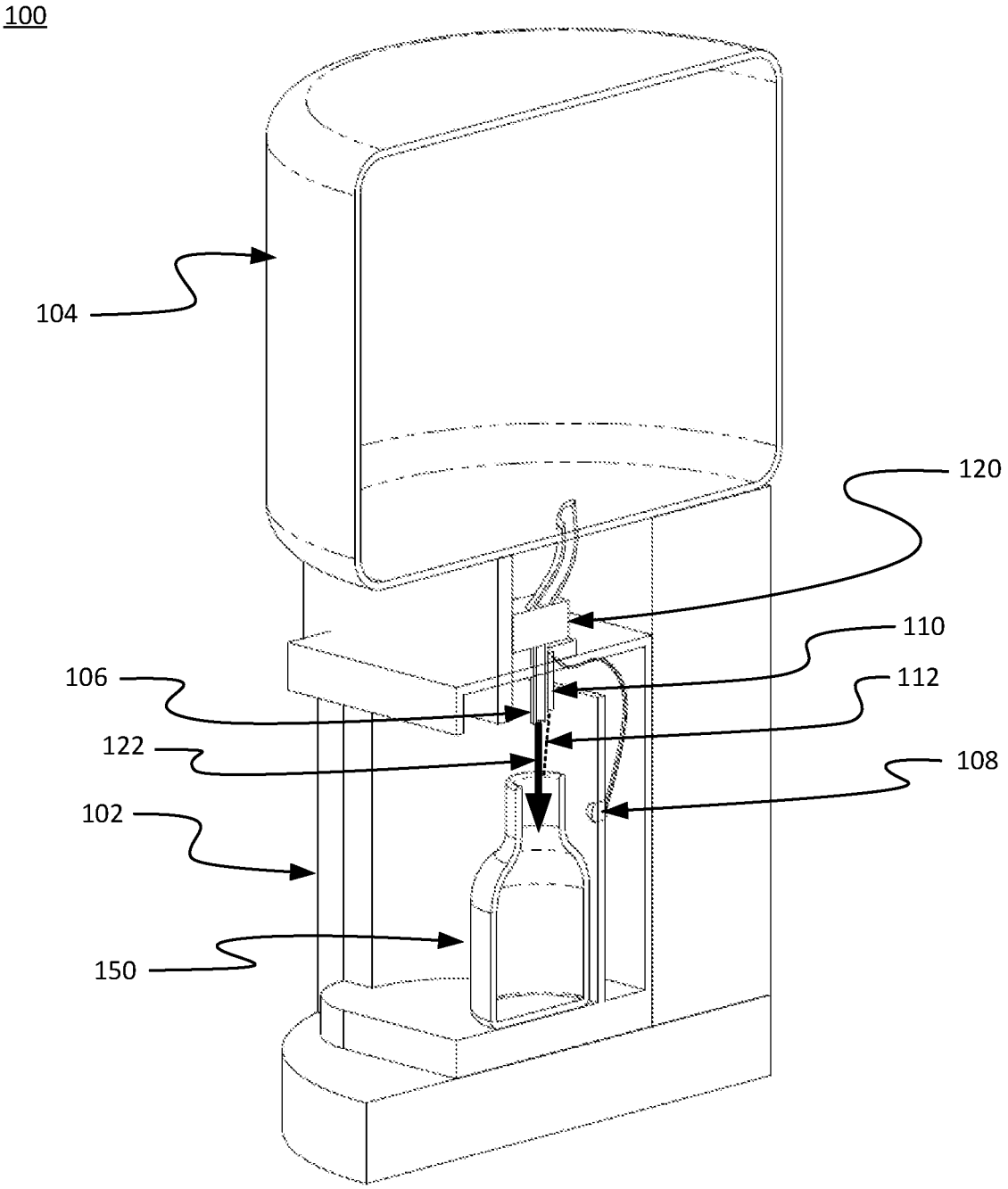
FIG. 2 illustrates a section view of a liquid dispenser, in accordance with various aspects of the subject technology.

FIG. 1 illustrates a perspective view of a liquid dispenser 100, in accordance with various aspects of the subject technology. The liquid dispenser 100 comprises a housing 102, a liquid source 104, an outlet 106 (as shown in FIG. 2), a proximity system 108, and a positioning system 110 (as shown in FIG. 2). The housing 102 is configured to mechanically support the outlet 106, proximity system 108 and the positioning system 110 and may comprise a rigid structure manufactured from polymers, composites, alloys or other materials as would be known by a person of ordinary skill.

In one aspect, the liquid dispenser 100 may be configured to dispense liquid, such as water, by actuation of a mechanical lever or button, such as by depression of a lever or push button associated with a valve that is configured to allow or prevent the flow of liquid through the valve. In another aspect, the liquid dispenser 100 may be configured to dispense liquid through actuation of a pump 120 (as shown in FIG. 2) in fluid communication with the liquid. The pump 120 may be actuated by a switch that is activated when a user depresses a lever or button. For example, a user may cause the pump 120 to dispense liquid by pushing a button or switch to provide power to the pump 120. In another example, the user may power the pump 120 by pushing a lever with a container 150 disposed underneath the outlet 106. In another example, as discussed further below, the user may cause the pump to be activated by simply disposing the container 150 underneath the outlet 106.

The liquid source 104 may comprise a tank of liquid, such as a 5-gallon bottle of water, a line of liquid, such as a water line, or other source of liquid as would be known by a person of ordinary skill.

FIG. 2 illustrates a section view of the liquid dispenser 100, in accordance with various aspects of the subject technology. The outlet 106 may comprise an end of a tube or nozzle disposed on the housing 102 that is configured to dispense liquid 122 from the liquid source 104 and into a container 150, such as a bottle, cup or glass.

The proximity system 108 may comprise a sensor connected to a processor (not shown). The sensor is configured to detect an object within a certain proximity or distance to the sensor, without any physical contact. The sensor may, for example, emit an electromagnetic field or a beam of electromagnetic radiation (e.g., infrared) and be configured to provide output signals to the processor for processing. The processor may be configured to determine whether the output signals indicate a change in a level of the output signal. In one aspect, a change may signify the presence of an object. Alternatively, the sensor may comprise a capacitive proximity sensor, photoelectric sensor, photosensor, photodetector, inductive proximity sensor, ultrasonic sensor, or other sensor as would be known by a person of ordinary skill that could be used to detect the presence of the container 150 or object disposed proximately to the outlet 106.

In one aspect, the proximity system 108 may be configured to detect the presence of the container 150 when the container 150 is moved in close proximity to the outlet 106. In another aspect, the proximity system 108 may be configured to continuously detect the position of the container 150 with respect to the outlet 106. In yet another aspect, the proximity system 108 may be configured to detect movement or adjustment of a position of the container 150 with respect to the outlet 106 or the proximity sensor.

The positioning system 110 may comprise a light source connected to a processor (not shown). The light source may be configured to project a beam of light 112 toward the container 150 to indicate to a user the approximate location of liquid 122 to be dispensed from the outlet 106. The beam 112 may comprise a target, crosshair, pinpoint, or other optical indicator sufficient to indicate to a user a location of the liquid 122 when dispensed. In one aspect, the positioning system 110 may be mounted at an angle such that a beam 112 projecting from the positioning system 110 intersects at a location proximate to an opening of the container 150. In one aspect, the light source may be mounted on an actuating member (e.g., mounting surface connected to a servo motor) that enables movement and direction of the beam 112 so that a location of the beam 112 may be directed towards the opening of the container 150. In one example, the positioning system 110 may comprise a laser beam emitter. In another example, the positioning system 110 may comprise an LED light source optically coupled to a light guide to focus light emitted by the LED to thereby project a pinpoint, target or crosshair such that the focused light indicates to a user the approximate location of the liquid 122 to be dispensed from the outlet 106. By indicating to the user an approximate location of the dispensed liquid 122, the user may relocate the opening of the container 150, as desired, to prevent and eliminate spills and subsequent cleanup.

In another aspect, the positioning system 110 may be configured to project a beam 112 having variable characteristics, such as color (e.g., red, blue, green), target (crosshairs, circle, square, point), and pattern (e.g., flashing patterns, pulsing pattern, varying intensity patterns) to indicate one or more characteristics of the liquid source 104. For example, the positioning system 110 may project a beam 112 having a red color if the liquid to be dispensed has a temperature that may be considered high, such as around 100 degrees Fahrenheit, and may project a beam 112 having a blue color if the liquid to be dispensed has a temperature that may be considered low, such as around 40 degrees Fahrenheit. By indicating to the user certain characteristics or properties of the liquid source 104 through varying characteristics of the beam 112, the user is able to easily discern a characteristic or property of the liquid source 104 without having to separately confirm the characteristic or property. For example, continuing with the example described in this paragraph, if the beam 112 is red in color, then the user is notified that the liquid that will be dispensed will have a high temperature. If the beam 112 is blue in color, then the user is notified that the liquid that will be dispensed will have a low temperature. By knowing the temperature of the liquid to be dispensed, the user may prevent inadvertent dispensing of liquid at an undesired temperature.

Figure 3:
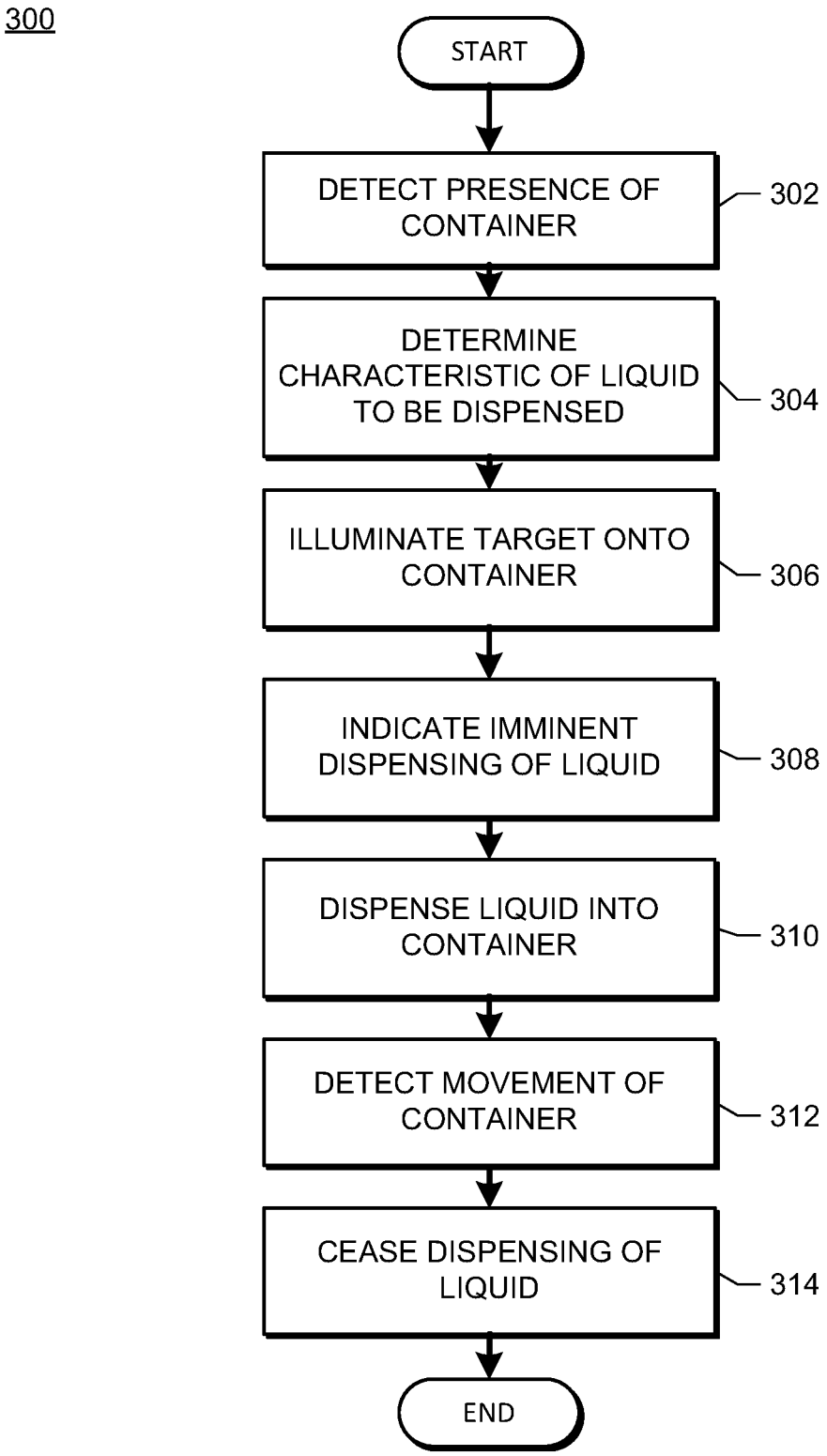
FIG. 3 illustrates a method for dispensing liquid, in accordance with various aspects of the subject technology.

FIG. 3 illustrates a method 300 for dispensing liquid, in accordance with various aspects of the subject technology. It should be understood that, for any process discussed herein, there can be additional, fewer, or alternative steps performed in similar or alternative orders, or in parallel, within the scope of the various aspects unless otherwise stated. The method 300 can be performed by a liquid dispenser having a proximity system and a positioning system (e.g., the water dispenser 100 of FIGS. 1 and 2).

At operation 302, the liquid dispenser detects the presence of a container. The container may be detected with a proximity sensor that is configured to detect the presence of the container when it is disposed at a particular distance from the proximity sensor. The detection may be performed by a proximity system (e.g., the proximity system 108 of FIGS. 1 and 2). If a container is detected, then the liquid dispenser at operation 304 determines a characteristic of liquid to be dispensed into the container. For example, for a liquid dispenser configured to dispense hot and cold water, the current setting for whether hot or cold water is to be dispensed is determined.

At operation 306, the liquid dispenser illuminates a beam of light onto the container to indicate to a user the approximate location of liquid when dispensed from an outlet. The illumination of the beam may be performed by a positioning system (e.g., the positioning system 110 of FIGS. 1 and 2). In one aspect, the beam is illuminated based on the detection of the container at operation 302. In other words, when the proximity sensor detects the container is proximate to the liquid outlet, the beam is illuminated to indicate to the user the approximate location of the liquid that will be dispensed by the liquid dispenser.

At operation 308, the liquid dispenser indicates that a dispensing operation is imminent. For example, the liquid dispenser may indicate to the user that liquid dispensing is about to commence by altering an illumination pattern, such as by causing the beam of light to begin flashing at an increasing frequency. In another example, an audible indication may be provided to the user to indicate to the user that a dispensing operation is imminent. In another aspect, the indication that a dispensing operating is imminent is initiated if the proximity sensor does not detect a change in position of the container after a predetermined amount of time has passed. In other words, if the proximity sensor detects no movement or adjustment of a position of the container with respect to the liquid outlet (e.g., outlet 106), the liquid dispenser indicates to the user that a dispensing operation is imminent.

At operation 310, the liquid dispenser provides power to a pump to activate the pump and dispense liquid into the container. In some aspects, the liquid dispenser provides power to the pump based on the detection of the container by the proximity sensor. In one aspect, by using an output signal of the proximity sensor to dispense liquid, the liquid dispenser dispenses liquid automatically. In other words, by using the proximity sensor to detect the container and initiate dispensing, a user does not need to push a button or lever to dispense the liquid.

At operation 312, the liquid dispenser detects movement or a change of position of the container using the proximity sensor. If the detected movement exceeds a predetermined threshold, the liquid dispenser proceeds to operation 314 and ceases dispensing of the liquid by removing power to the pump or by otherwise deactivating the pump. Detected movement that exceeds a predetermined threshold indicates that the container has moved a sufficient amount that a spill may occur. As such, the liquid dispenser stops dispensing liquid by, for example, cutting power to the pump. In another example, a user may simply cause the liquid dispenser to cease dispensing liquid by causing the container to move in a minimal amount, such as by simply moving, tilting, or otherwise adjusting the position of the container by an amount of about 1 mm, or by placing their fingers on the container thereby causing the proximity sensor to output a signal with a varied value. In other words, the liquid dispenser may be configured to cease dispensing liquid (after dispensing has commenced), by reducing a threshold value of the output signal from the proximity sensor so that any change in the output signal, will result in the liquid dispenser ceasing liquid dispensing operations.

The liquid dispenser may include at least one processing unit (CPU or processor) connected to various system components including memory, such as read only memory (ROM) and random access memory (RAM). The liquid dispenser may also include a cache of high-speed memory connected directly with, in close proximity to, or integrated as part of processor.

The processor can include any general purpose processor and a hardware service or software service stored in a storage device, configured to control processor as well as a special-purpose processor where software instructions are incorporated into the actual processor design. Processor may essentially be a completely self-contained computing system, containing multiple cores or processors, a bus, memory controller, cache, etc. A multi-core processor may be symmetric or asymmetric.

Storage device can be a non-volatile memory device and can be a hard disk or other types of computer readable media which can store data that are accessible by a computer, such as magnetic cassettes, flash memory cards, solid state memory devices, digital versatile disks, cartridges, random access memories (RAMs), read only memory (ROM), and/or some combination of these devices.

The storage device can include software services, servers, services, etc., that when the code that defines such software is executed by the processor, it causes the system to perform a function, such as detection of a container, detection of movement of the container, control of a light beam, and other functions as described above. In some embodiments, a hardware service that performs a particular function can include the software component stored in a computer-readable medium in connection with the necessary hardware components, such as processor, to carry out the function.

It will be appreciated that the liquid dispenser can have more than one processor, or be part of a group or cluster of computing devices networked together to provide greater processing capability.

For clarity of explanation, in some instances the various embodiments may be presented as including individual functional blocks including functional blocks comprising devices, device components, steps or routines in a method embodied in software, or combinations of hardware and software.

In some aspects the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can comprise, for example, instructions and data which cause or otherwise configure a general purpose computer, special purpose computer, or special purpose processing device to perform a certain function or group of functions. The computer executable instructions may be, for example, binaries, intermediate format instructions such as assembly language, firmware, or source code. Examples of computer-readable media that may be used to store instructions, information used, and/or information created during methods according to described examples include magnetic or optical disks, flash memory, USB devices provided with non-volatile memory, networked storage devices, and so on.

The instructions, media for conveying such instructions, computing resources for executing them, and other structures for supporting such computing resources are means for providing the functions described in these disclosures.

The foregoing description is provided to enable a person skilled in the art to practice the various configurations described herein. While the subject technology has been particularly described with reference to the various figures and configurations, it should be understood that these are for illustration purposes only and should not be taken as limiting the scope of the subject technology.

There may be many other ways to implement the subject technology. Various functions and elements described herein may be partitioned differently from those shown without departing from the scope of the subject technology. Various modifications to these configurations will be readily apparent to those skilled in the art, and generic principles defined herein may be applied to other configurations. Thus, many changes and modifications may be made to the subject technology, by one having ordinary skill in the art, without departing from the scope of the subject technology.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. A phrase such an embodiment may refer to one or more embodiments and vice versa.

Furthermore, to the extent that the term "include," "have," or the like is used in the description or the claims, such term is intended to be inclusive in a manner similar to the term "comprise" as "comprise" is interpreted when employed as a transitional word in a claim.

The word "exemplary" is used herein to mean "serving as an example, instance, or illustration." Any embodiment described herein as "exemplary" is not necessarily to be construed as preferred or advantageous over other embodiments.

A reference to an element in the singular is not intended to mean "one and only one" unless specifically stated, but rather "one or more." The term "some" refers to one or more. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

What is claimed is:

1. A method for dispensing liquid, the method comprising:
illuminating a beam of light to identify a location of liquid to be dispensed from an outlet of a liquid dispenser;
altering an illumination pattern of the beam of light to inform a user that a dispensing operation is imminent;
detecting, by a proximity sensor, movement of a container disposed proximate to the outlet; and
ceasing dispensing of the liquid, by deactivating a pump, based on the detected movement of the container;
wherein a processor is configured to illuminate the beam of light, alter the illumination pattern of the beam of light, determine movement of the container, and deactivate the pump.

2. The method of claim 1, wherein the method further comprises determining whether the container is disposed proximate to the outlet; and dispensing the liquid into the container based on the placement of the container.

3. The method of claim 1, wherein the method further comprises altering a color of the beam of light based on a temperature of the liquid.

4. The method of claim 1, wherein the method further comprises adjusting a position of the beam of light to direct the beam of light toward an opening of the container.

5. A liquid dispenser, comprising:
an outlet for dispensing liquid into a container;
a proximity sensor configured to detect the container when the container is disposed proximate to the outlet;
a light source configured to emit a beam of light to identify a location of liquid to be dispensed from the outlet;
a pump; and
a processor configured to:
illuminate the light source to inform a user of the location of liquid to be dispensed from the outlet;
alter an illumination pattern of the beam of light;
determine-movement of the container based on an output signal from the proximity sensor; and
automatically deactivate the pump to cease dispensing liquid based on movement of the container.

6. The liquid dispenser of claim 5, wherein the processor is further configured to determine whether the container is disposed proximate to the outlet based on the output signal from the proximity sensor; and automatically activate the pump to dispense liquid based on the output signal from the proximity sensor.

7. The liquid dispenser of claim 5, wherein the processor is further configured to:
determine a property of the liquid; and
alter a characteristic of the beam of light based on the property of the liquid.

8. The liquid dispenser of claim 7, wherein the property of the liquid comprises a temperature of the liquid.

9. The liquid dispenser of claim 7, wherein the characteristic of the beam of light comprises a color of the beam of light.

10. The liquid dispenser of claim 5, wherein the light source is mounted on an actuating member to alter a location of the beam of light.

* * * * *